United States Patent [19]

Platt

[11] 4,068,503

[45] * Jan. 17, 1978

[54] COMBINED OSCILLATING AND UNIDIRECTIONAL AGITATOR FOR AUTOMATIC WASHER

[75] Inventor: Clark I. Platt, St. Joseph, Mich.

[73] Assignee: Whirlpool Corporation, Benton Harbor, Mich.

[ * ] Notice: The portion of the term of this patent subsequent to Oct. 26, 1993, has been disclaimed.

[21] Appl. No.: 696,746

[22] Filed: June 16, 1976

Related U.S. Application Data

[63] Continuation-in-part of Ser. No. 595,792, July 14, 1975, Pat. No. 3,987,651, which is a continuation of Ser. No. 418,378, Nov. 23, 1973, abandoned.

[51] Int. Cl.[2] ..... D06F 13/06

[52] U.S. Cl. ..... 68/133; 68/134; 74/126; 366/243

[58] Field of Search ..... 68/131–134, 68/28, 38, 53, 54, 89, 184, 23.6, 23.7; 259/101; 74/126; 192/46; 416/124, 169, 172

[56] References Cited

U.S. PATENT DOCUMENTS

| | | | |
|---|---|---|---|
| D. 196,194 | 9/1963 | Krolzick | D49/1 |
| 1,704,932 | 3/1929 | Altorfer | 68/133 |
| 1,834,936 | 12/1931 | Bryant | 68/133 |
| 2,021,097 | 11/1935 | Maus | 68/133 |
| 2,253,989 | 8/1941 | Skinner | 68/54 X |
| 2,303,979 | 12/1942 | Blake | 68/23.7 X |
| 2,331,897 | 10/1943 | Dyer | 68/23.7 X |
| 2,502,702 | 4/1950 | Castner | 68/134 |
| 2,734,367 | 2/1956 | Geldhof | 68/133 |
| 3,112,632 | 12/1963 | Walton | 68/54 |
| 3,117,434 | 1/1964 | Byrd et al. | 68/134 |
| 3,285,040 | 11/1966 | Bochan | 68/134 |
| 3,381,504 | 5/1968 | Smith | 68/134 X |
| 3,678,714 | 7/1972 | Krolzick | 68/131 |
| 3,783,652 | 1/1974 | Archbold | 68/23.7 |
| 3,987,651 | 10/1976 | Platt | 68/134 X |

*Primary Examiner*—Philip R. Coe

*Attorney, Agent, or Firm*—Hill, Gross, Simpson, Van Santen, Steadman, Chiara & Simpson

[57] ABSTRACT

Improved agitation means for use in a clothes washing machine of the type in which an agitator is oscillated by means of a drive mechanism to secure agitation of the clothes placed within the washing machine. The present invention provides a first agitator element and a second agitator element driven from a common driving source, the second agitator element being provided with means to urge clothes into a rollover pattern established by the coaction of the agitator elements and thereby impart a highly efficient rollover motion to the clothes. The first agitator element, which may employ either rigid or flexible vanes, or a combination thereof, is preferably located below and coaxial to the second agitator element which may be driven either intermittently, or continuously, in a unidirectional rotary motion.

17 Claims, 9 Drawing Figures

Fig. 5
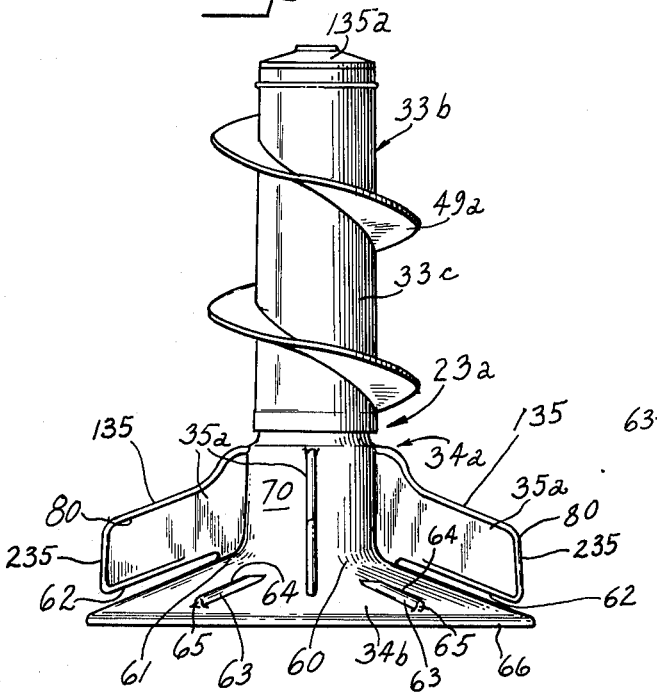
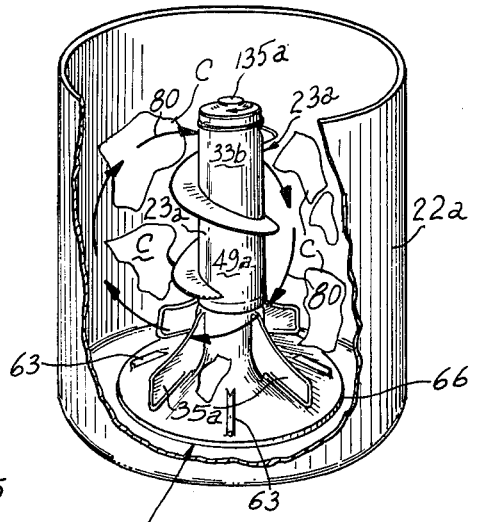
Fig. 8
Fig. 6
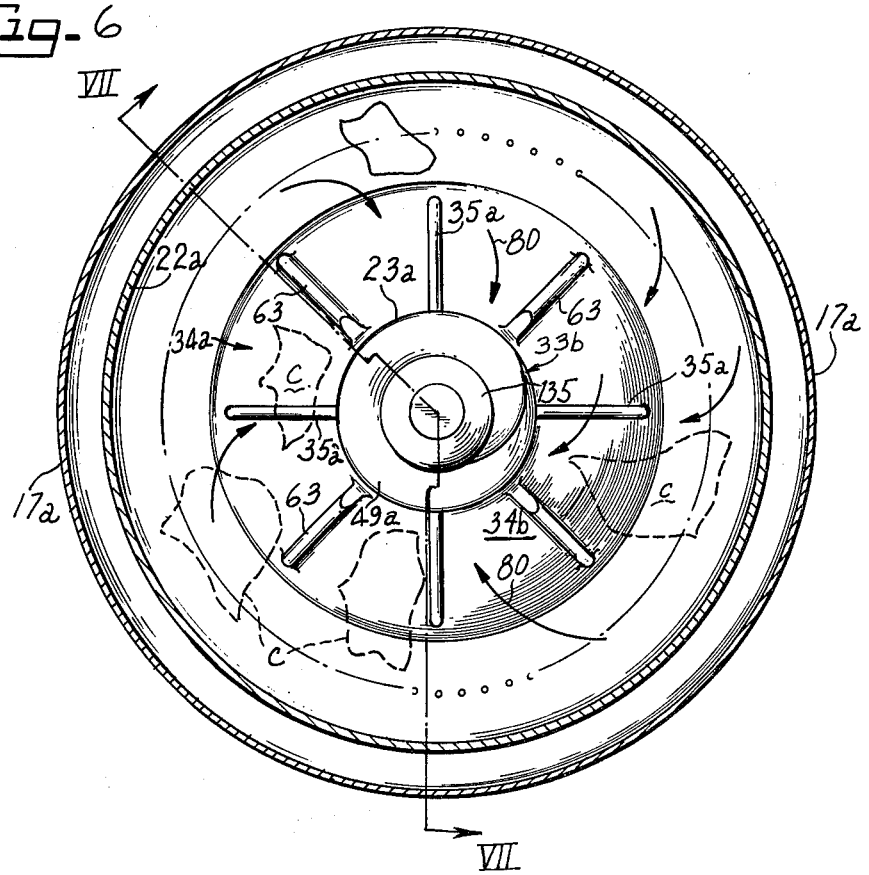

COMBINED OSCILLATING AND UNIDIRECTIONAL AGITATOR FOR AUTOMATIC WASHER

REFERENCE TO PARENT APPLICATIONS

This is a Continuation-in-Part of application Ser. No. 595,792, filed July 14, 1975, now U.S. Pat. No. 3,987,651 granted Oct. 26, 1976, which is a Continuation of application Ser. No. 418,378, filed Nov. 23, 1973, now abandoned.

BACKGROUND OF THE INVENTION

1. Field of the Invention

This invention is in the field of automatic washing machines employing vertical axis agitators which oscillate to provide a tumbling or generally toroidal motion to the clothes in washing the clothes contained within the machine and provides an agitator construction which is particularly useful with large or heavy clothes loads to improve the movement of the clothes within the machine and thereby the washing action.

2. Description of the Prior Art

It has long been appreciated that the most efficient clothes movement pattern for washing clothes within an automatic washing machine having a vertical axis agitator is a pattern which provides a rollover of the clothes which involves moving the clothes down the agitator barrel, then radially outward from the oscillating agitator vanes, upward along the wall of the tub, and inward to the barrel. Conventional washing machines are reasonably proficient in achieving this type of rollover pattern when light loads are being washed, but not with heavy loads. When the washing basket is tightly packed with clothes, the load crowds the agitator and the basket area. A conventional oscillating agitator has difficulty in attaining any kind of a rollover to the clothes load under these conditions. The conventional-type agitator then scrubs merely the bottom portion of a tightly-packed heavy load, resulting in a very poor uneven cleaning action.

There are a few examples in prior patents of agitators which move in separate paths during a washing operation. For example, the Bryant U.S. Pat. No. 1,834,936 suggests dual agitator members which are reciprocated in opposite directions within the tub, the object being to create a violent water action.

The Krolzick U.S. Pat. No. 3,678,714 assigned to the same assignee as the present invention described a washing machine assembly including a pair of agitators, the two agitators being coupled together for mutual oscillation, but having cam means or the like provided between the two agitators to effect a vertical reciprocation of one with respect to the other during such oscillation.

Prior art patents disclose agitators with spiral vane elements. For example, Dyer U.S. Pat. No. 2,331,897 discloses a washing machine having an agitator provided with a spiral vane on an upper portion, the agitator rotating at motor speed during washing.

Krolzick U.S. Pat. No. 196,194 assigned to the same assignee as the present invention shows an agitator for a laundry machine wherein the ornamental design for the agitator includes a spiral vane arrangement.

Geldhof U.S. Pat. No. 2,734,367, assigned to a predecessor of the assignee of the present invention, shows an agitator for a laundry machine wherein the agitator includes spiral vanes which extend in the form of radial vanes on their lower edges with radial projections or vanes extending intermediate the spiral vanes.

Flexible agitator vanes have been used in combination with an agitator skirt portion as in U.S. Pat. No. 3,307,383 to Cobb et al assigned to the assignee of the present invention. That patent shows flexible vanes attached to the center agitator post and spaced above a skirt to reduce tangling of fabrics on the agitator vanes.

Walton U.S. Pat. No. 3,112,632 discloses an agitator having a ribbed and grooved agitator barrel and flexible vanes for reducing tangling of clothing on such vanes during oscillation of the agitator.

U.S. Pat. No. 3,381,504 to Smith shows flexible vanes attached to the center agitator post and spaced above a skirt with the spacing increasing toward the outer periphery of the skirt.

U.S. Pat. No. 3,608,110 to Hubbard et al shows an agitator assembly having small upper vanes connected to lower vanes by helical vane sections, the lower vanes being substantially flexible. The entire agitator having the three classes of vanes oscillates back and forth together with the skirt lying beneath but unattached to the lower vanes, in an attempt to achieve a toroidal movement of clothing and washing fluid in the washing tub.

The following additional references are part of the prior art for consideration in connection with the present invention.

| | | |
|---|---|---|
| Altorfer | 1,704,932 | 3/1929 |
| Maus | 2,021,097 | 11/1935 |
| Skinner | 2,253,989 | 8/1941 |
| Castner | 2,502,702 | 4/1950 |
| Byrd et al. | 3,117,434 | 1/1964 |
| Bochan | 3,285,040 | 11/1966 |

In general, the prior art has provided agitators having only oscillatory motions, attempting to achieve good rollover of clothing in the washing tub by increasing the vigor of the agitation.

In contrast, the co-pending application of Platt, the present applicant, U.S. Ser. No. 595,792, assigned to the assignee of the present application, discloses a double acting auger agitator comprising a combination oscillating and unidirectional agitator for an automatic washer, having a unidirectional auger provided with a helical vane and one set of oscillating lower or scrubbing vanes.

Double acting auger agitators of the type generally disclosed in the above-mentioned application Ser. No. 595,792, of Platt include a vaned lower agitator element mounted for oscillating motion about an axis of a washer and an upper agitator element mounted for unidirectional rotation about the same axis, the upper auger agitator element having helical vane means associated therewith for forcing or deflecting clothes in the washer adjacent the upper agitator element downward toward the oscillating vanes on the lower portion of the agitator. The described operation of the auger agitator is effective to promote the desired continuous rollover movement of the clothes and fabrics undergoing washing, resulting in improved and more uniform washability of the clothes load.

Additionally, a co-pending application by Ruble, U.S. Ser. No. 575,730, filed May 8, 1975, assigned to the assignee of the present invention, discloses a double acting auger agitator comprising an oscillating vertical-axis agitator in combination with an agitator accessory having a sleeve for mounting on the agitator and a helical vane projecting from the sleeve in the form of an auger. The auger agitator accessory is rotated in one direction via a one-way clutch during one-half cycles of the oscillating agitator.

SUMMARY OF THE INVENTION

The present invention provides an improved agitator means for use with an automatic washer having a clothes washing receptacle and drive means for driving an agitator in an oscillatory fashion. The improved agitator means of the present invention is a double action agitator and includes a lower agitator element which is engageable with the drive means for oscillation about an axis in the usual manner and an upper agitator element which is coaxial with the lower element and is coupled to the drive shaft by means of a one-way clutch for unidirectional rotation about the axis of the agitator. The upper agitator element is provided with auger-like vane means for urging clothes within the receptacle downwardly toward the lower agitator element where they are contacted by a set of generally vertically-extending vanes disposed about the skirt portion of the lower agitator element. In effect, therefore, the upper agitator element acts to continuously feed clothes downwardly along the barrel of the agitator where they come under the influence of the oscillating vertically positioned vanes of the lower agitator element which direct the clothes radially outwardly toward the periphery of the basket, and eventually upwardly and back to the barrel of the upper agitator element, completing a repeating rollover cycle which is extremely efficient for securing a uniform scrubbing contact of the clothes with the wash liquid.

A preferred form of the agitator assembly of the present invention is shown herein having a unidirectionally rotating agitator element and an associated agitator element with both rigid and flexible vanes on and above an oscillatable agitator skirt.

Additionally, there is shown a modification of the invention providing a continuous rotary motion for one of the agitator elements and an oscillatory motion for the other of the agitator elements.

BRIEF DESCRIPTION OF THE DRAWINGS

Other objects, features and advantages of the invention will be readily apparent from the following description of certain preferred embodiments thereof, taken in conjunction with the accompanying drawings, although variations and modifications may be effected without departing from the spirit and scope of the novel concepts of the disclosure, and in which:

FIG. 5 is a view in elevation of a preferred form of the agitator assembly of the present invention;

FIG. 6 is a top plan view of the agitator assembly of FIG. 5 mounted in a perforated basket positioned within an imperforate fluid retaining tub with an arrow adjacent the agitator axis indicating the direction of rotation of the auger agitator, and arrows indicating the movement of clothes about the axis of rotation of the auger agitator of the present invention;

FIG. 8 is a perspective view of the structure of FIG. 7 with a wall portion of the basket being removed to better illustrate the movement of clothes about the axis of rotation of the auger agitator.

DESCRIPTION OF THE PREFERRED EMBODIMENTS

Figure 1:
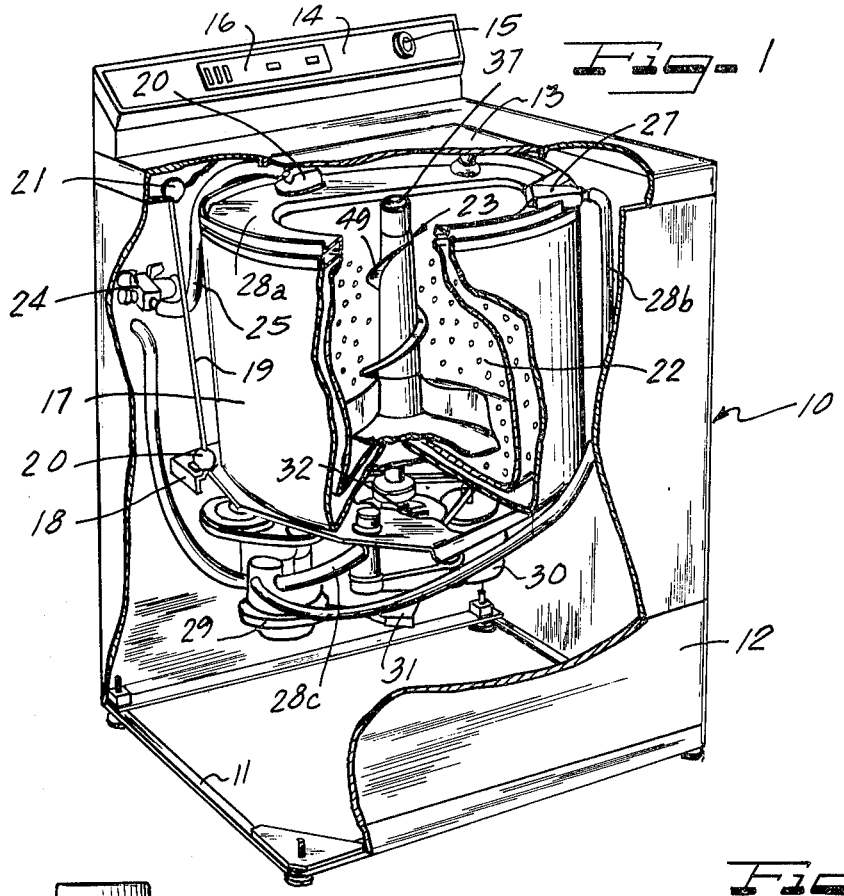
FIG. 1 is a view partly broken away, of a conventional automatic washing machine assembly provided with an improved agitator means according to the present invention.

In FIG. 1, reference numeral 10 indicates generally a washing machine of the automatic type including a frame 11 carrying vertical panels 12 forming the sides, front and back of the cabinet for the washing machine 10. A hinged lid 13 is provided in the usual manner to provide access to the interior of the washing machine. The washing machine 10 has the usual console 14 including a timer dial 15 and a program selector 16.

Internally of the machine 10 there is disclosed an imperforate fluid retaining tub 17 which is supported within the washing machine cabinet by means of a base support plate 18. A plurality of suspension rods 19 having resilient spherical end portions 20 and 21 are positioned about the tub 17 in the usual manner to suspend the tub 17 freely within the interior of the cabinet for the washing machine.

A perforate washing receptacle or basket 22 is positioned concentrically within the tub 17. Centrally of the perforate washing basket 22 is an improved agitator means which has been designated generally in the drawings by the reference numeral 23.

Liquid is introduced into the washing machine by means of a solenoid controlled inlet valve 24 which directs the liquid through a conduit 25 and through an anti-siphon device **20*a* into the washing machine. A filter 27 is positioned along a tub ring 28*a* disposed between the tub 17 which receives the washing fluid and the basket 22 which receives the clothing or other fabrics to be cleaned therein. A conduit 28*b* connects the outlet port of a pump 29 to the filter 27, and a second conduit 28*c* provides fluid communication between the inlet port of pump 29 and the clothes washing zone within basket 22 of the washing machine. During the agitate portion of the wash cycle wash water is circulated by the pump 29 through conduit 28*b* to filter 27, from the filter into the washing zone, and from the washing zone through a second conduit 28*c* back to the pump 29**. A filtering of the wash water is thus accomplished.

The pump 29 as well as the other movable parts of the assembly are driven by means of a motor 30 which operates through a transmission 31. A clutch and brake assembly generally indicated by the reference numeral 32 is provided for energizing the agitator means 23 during washing, and for disengaging the agitator and engaging a basket spin tube, subsequently to be described, for spinning the basket 22 during the liquid extracting portion of the washing phase. All of the drive elements and hydraulic units described thus far are conventional in vertical-axis automatic washing machines, and the improvements of the present invention are centered in the agitator means 23, which is described specifically below.

Figure 2:
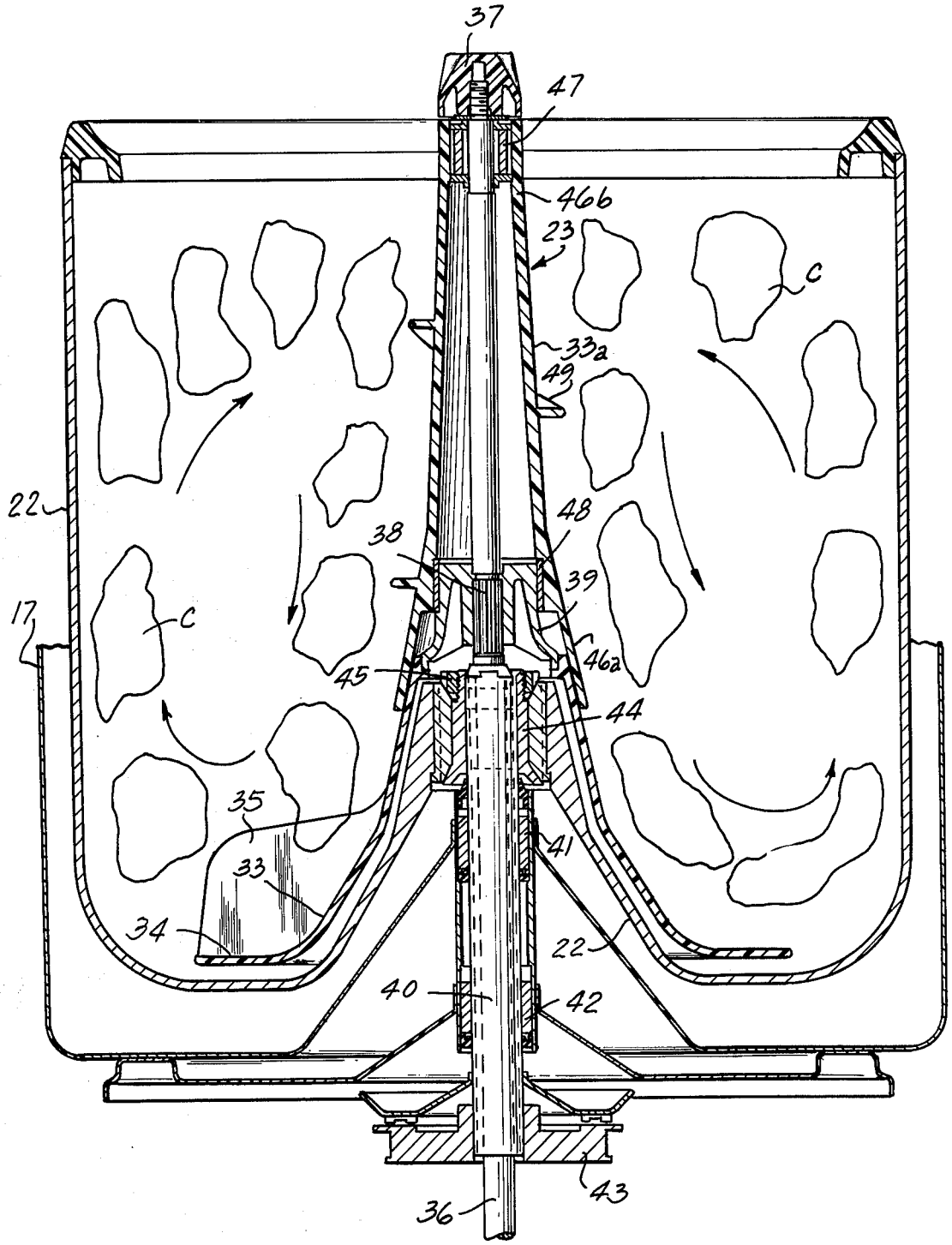
FIG. 2 is a vertical cross-sectional view of the improved agitator means of the present invention during a washing cycle showing the manner in which the clothes are rolled over to ensure efficient contact with the wash liquid.

As seen in FIG. 2, the agitator means 23 has a lower agitator element 33 with a skirt portion 34 which carries a plurality of spaced, generally vertical agitator vanes 35. An agitator drive shaft 36 extends through the lower agitator element 33 and an upper agitator element 33*a* and is threadedly received within an agitator cap 37. The shaft 36 has a splined portion 38 which is rigidly connected to an agitator drive coupler 39 for oscillating the lower agitator element 33 in the usual manner.

A spin tube 40 surrounds the shaft 36 over a portion of its length and is received between spaced bearings 41 and 42. A pulley 43 is provided about the spin tube 40 for mechanical connection to a drive motor and transmission in the usual manner. The upper end of the spin tube is received within a basket drive block 44 and its associated nut 45 to drive the basket 22 at high speed during the extraction cycle when wash liquid is removed from the clothes by centrifugal force.

Figure 3:
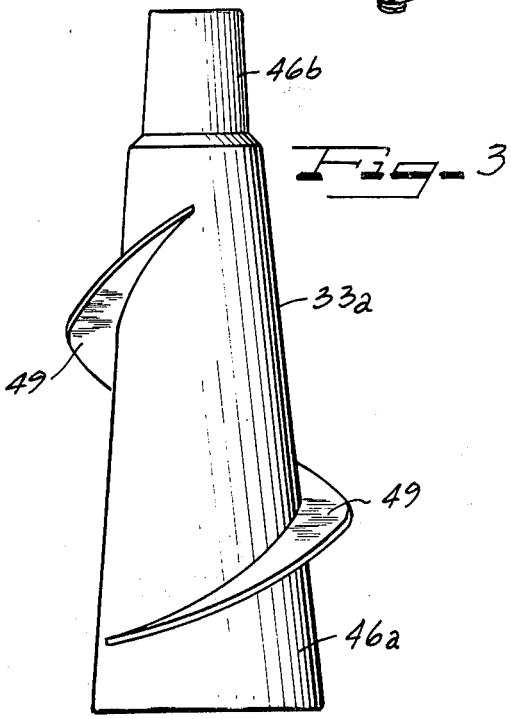
FIG. 3 is a view in elevation of the upper agitator element shown in the assembly of FIG. 2.

The upper agitator element 33*a* is composed of a synthetic resin or the like and, as illustrated in FIGS. 2 and 3 is hollow and has a larger-diameter end portion 46*a* in the area adjacent to the lower agitator element 33, and a smaller-diameter upper portion 46*b* at the upper end thereof. As best illustrated in FIG. 2, the lower end of the upper agitator element 33*a* is received in overlapping relationship with the upper portion of the lower agitator element 33. The agitator drive shaft 36 extends up through the upper agitator element 33*a* and is mechanically coupled thereto through a one-way drive mechanism such as a one-way clutch 47 (which may be for example, a Torrington positive grip one-way roller clutch model RCB-101416 ) located at the upper end of the shaft 36. A sleeve bearing 48 provides for relative movement between the lower agitator element 33 and the upper agitator element 33*a*.

The outer periphery of the upper agitator element 33*a* is provided with vane means 49 for urging clothes downwardly. A continuous helical vane 49 is shown extending outwardly from the conical wall of the upper agitator element 33*a* down the length of the upper agitator element 33*a* and terminating short of the vertical agitator vanes 35 for urging or deflecting clothes downwardly. With the arrangement shown, the upper agitator element 33*a* is positively driven through one-way clutch 47 only when the agitator drive shaft 36 is moved in a counter-clockwise direction. Under very light loads, which may tend to be submerged adjacent the lower agitator element 33 and not in sufficient contact with the upper element 33*a*, the upper agitator element 33*a* will tend to oscillate with the lower agitator element 33. However, as basket 22 is loaded with increasingly larger fabric loads, these larger bulk loads consistently come into greater contact with agitator vanes 49 so that when the agitator drive shaft 36 moves in a clockwise direction, the one-way clutch 47 allows the upper agitator element to remain relatively stationary due to the frictional drag placed thereon by the water and clothes within the basket. Thus there is substantially automatic sensing of the magnitude of the clothes load to provide incremental rotation under clothes load conditions. This incremental or intermittent rotation of the upper agitator element 33*a* with a clothes load provides a double acting agitator and causes the helical vane 49 to act as an auger and thus auger or urge the clothes identified at reference numeral C downwardly along the upper agitator element 33*a* into the oscillating vertical agitator vanes 35 which move the clothes out radially toward the periphery of the basket 22, thence upwardly and inwardly toward the upper agitator element 33*a*, all as indicated by the arrows shown in FIG. 2 of the drawings. This creates a highly desirable generally toroidal rollover movement or action which subjects the clothes to intimate contact with the washing liquid and to effective scrubbing action from the lower agitator element 33. (In FIG. 2, the washing liquid has been omitted, and only a partial clothes load has been illustrated for purposes of clarity.)

Figure 4:
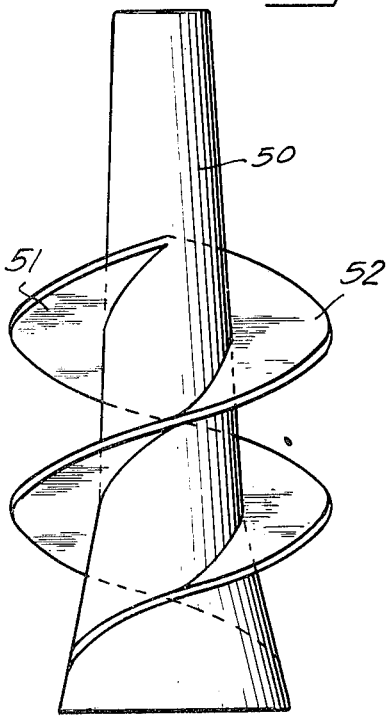
FIG. 4 is an elevational view of a modified form of upper agitator element which can be used for the purposes of the present invention.

A modified form of upper agitator element 50 for use in the present invention is illustrated in FIG. 4 of the drawings. This figure illustrates an upper agitator element 50 having two helical vanes 51 and 52 each having a pitch differing somewhat from the pitch of the helical vane 49 shown in detail in FIG. 3 which advantageously may have one and one-quarter turns over the length of upper agitator element 33*a*. The pitch of these helical vanes affects the rate at which clothes are moved downwardly along the upper agitator element 33*a* into the oscillatory path of the lower agitator element 33. A greater pitch of these helical vanes increases the rate at which fabrics are fed into the path of the lower agitator element.

In the development and evaluation of rollover action agitators which, as disclosed herein, employ an upper unidirectional auger element in mutual cooperation with a lower oscillating agitator element it has been determined that the operational efficiency of, and uniformity of washability by, such agitators are substantially directly related to the magnitude of the rollover of the fabrics in a generally toroidal path during an average washing operation as produced by the cooperation of these upper and lower agitator elements. The cooperative relationship between these upper and lower agitator elements is important since the upper auger or helical portion continually forces or deflects the fabrics in a downwardly direction into the oscillatory path of the lower agitator element which is thereby enabled to better clean and scrub such fabrics. However, since there are other fabrics which have already been previously gravitationally positioned adjacent this same lower agitator element, the continual forcing of fabrics toward the bottom portion of the agitator assembly tends to produce a concentrated mass or bulk of fabrics in the lower central portion of the washing receptacle and ultimately in and around the entire oscillatory lower vaned agitator element 33.

Since the torque loads sensed by the oscillatory agitator drive shaft 36 are dependent upon the nature and mass of the fabrics engaged by the lower agitator element 33, a compacted fabric mass engaging that agitator may tend to increase the torque loads sensed by drive shaft 36 and ultimately by the motor 30 powering that drive shaft. In addition, the creation of the relatively immobile, or at least slowly moving, fabric mass tends to retard or interfere with a continually progressing fabric rollover pattern which is desirable for the more uniform scrubbing of all fabrics placed within the clothes basket 22.

It is therefore important that the fabrics fed by the helical vane means 49 downwardly toward the lower agitator element 33 during a first portion of the toroidal rollover pattern for such fabrics also be moved radially outwardly from said agitator and upwardly along the inner sidewalls of the basket 22 in the second half portion of that desired toroidal cycle or rollover pattern within that basket. The helical pitch design and dimensions of the upper agitator element are therefore important in determining the downward feed rate of the upper agitator element.

The type, configuration and size characteristics of the lower vaned agitator element 33 are also significant in promoting an optimum movement of fabrics away from the lower central washing zone within basket 22. Whereas the embodiments shown in FIGS. 1–4 herein illustrate the use of a rigid agitator vaned element, the embodiments shown in FIGS. 5–9 utilize agitator vanes of the flexible type or of a combination of flexible and rigid vanes.

The use of flexible agitator vanes on the lower agitator element allows such flexible vanes to yieldingly engage the fabrics deflected downwardly and thereby lessens the imposition of somewhat instantaneous high impact loading of the agitator, the agitator drive shaft and ultimately the motor driving it. These vanes also flex upon engagement with fabrics so as to unload fabrics which might otherwise catch on and be carried by the upper helically vaned auger element itself. This unloading of the vanes tends to avoid tangling of fabrics on the agitator which might otherwise lead to increased agitator shaft torque, increased motor wattage, reduced rollover as well as unbalanced spin loads and generally tangled clothes loads.

A co-pending application of John W. Pielemeier, Application Ser. No. 628,585, filed Nov. 4, 1975, "Ramped Scrubbing Vanes for Auger Agitator", assigned to the assignee of the present invention, discloses an alternative solution to the promotion of improved rollover and consistent washability in an auger type agitator.

SUMMARY OF THE PREFERRED EMBODIMENT OF THE INVENTION

In accordance with the principles of the preferred embodiment of the present invention, a double acting agitator comprising an upstanding center post and a lower curved transition base portion area blending into an outwardly and downwardly inclined or flared skirt is provided at circumferentially spaced points with a plurality of vertically-extending flexible vanes integrally connected with the center post along an axial length of the center post as well as through the curved transition area and a portion of the skirt area. The vertically-extending flexible vanes are provided with a desired degree of flexibility to promote the desired degree of clothes and fabric movement away from the base of the agitator in cooperation with the upper auger portion as generally described above for better fabric rollover. Each of the flexible vanes terminates inwardly of the flange of the flared skirt. Alternately spaced between the flexible vanes are smaller rigid vanes integral with an upstanding relative to the skirt. The flexible and rigid vanes the skirt all oscillate together rotationally about the center post.

In combination with the flexible and rigid vanes on the lower part of the agitator, an auger element characterized by a cylindrical tube having a radially outwardly projecting helical vane telescopes over the upright portion of the agitator center post. During agitation the auger element rotates to move wash fluid and clothing downwardly adjacent the central agitator post.

It is a main object of the present invention to provide positive and rapid generally toroidal rollover or turnover movement of clothing, fabrics and washing fluid in the washing receptacle or tub, moving the clothes or fabrics downwardly adjacent the agitator post, outwardly at the bottom of the washing tub, upwardly along the sides of the tub, and inwardly at the surface of the washing fluid, all without undue tangling of the clothes load, thereby avoiding excessive agitator shaft torque, high motor wattage and the like. It is also an object of the invention to provide improved, more uniform scrubbing action to the clothing being washed.

DESCRIPTION OF THE PREFERRED EMBODIMENT

In accordance with the principles of the present invention, four flexible vanes 35*a* are attached integrally to the oscillatory skirt portion 34*a* and centerpost 70 of the agitator assembly 23*a* along the transition area 60 and a portion 61 of the skirt 34*a*. Further, each flexible vane 35*a* has an upper edge 135 extending generally radially outwardly and inclined slightly from the horizontal. An outer or vertical edge 235 extends generally vertically and terminates in a lower edge 62 which extends generally radially inwardly and which is separated from a skirt 34*b* for a substantial portion of the length of the vane so that the free end of each vane 35*a* is free to flex when subjected to oscillatory forces.

It will be noted that the skirt 34*b* extends under each of the flexible vanes 35*a* and is disposed generally in a subjacent relation thereto. Moreover, each of the vanes 35*a* is separated from the skirt 34*b* along a greater portion of its length by a space between the skirt 34*b* and the lower edge 62 of the vane 35*a*, thereby to allow flexing of the vane during a washing action. By virtue of the free or detached upper, outer and lower edges 135, 235, and 62, free flexing of the vanes 35*a* is facilitated. Therefore, under heavy wash load conditions the flexible vanes 35*a* yieldingly engage fabrics deflected downwardly thereby lessening high impact loading of the skirt portion 34*a* of the agitator assembly.

A generally cylindrical bead 80 which is greater in diameter than the thickness of the flexible vane 35*a* is provided on the edges 135, 235 and 62 and provides some resistance to formation of nicks and gouges in the vane which could tend to snag or catch the fabrics being washed.

Four small rigid vanes 63 are provided on the upper surface of the skirt 34*b* of the agitator assembly 23*a*. The rigid vanes 63 are spaced equidistantly about the circumference of the skirt 34*b*, approximately 45° offset from the four flexible vanes 35*a*. Each rigid vane 63 has a generally horizontal upper edge 64, and a generally vertical edge 65 which is spaced radially outwardly from the axis of the agitator assembly 23*a* at a slightly smaller distance than the outer part of the skirt flange 66. The vanes 63 may be hollow with cavities opening from the lower surface of the skirt 34*b*. Each rigid vane 63 is integrally attached along its lower edge portions to the skirt 34*b*. The edges 64 and 65 of the rigid vanes 63 are rounded, as shown. The flexible vanes 35*a* and the rigid vanes 63 extend radially with respect to center post 70 of the skirt and consititute the main scrubbing vanes of agitator assembly 23*a*.

Coaxial with the center post 70 of the skirt and vane portion of the agitator assembly 23*a* is an auger tube 33*b* of the auger portion of the agitator assembly 23*a*. The agitator assembly 23*a* is closed at the top of the auger barrel portion or tube 33*b* by a cap 135*a*. The auger tube 33*b* is driven about the axis of the washing machine tub 17*a* through a type of clutch 75 (FIG. 7) at the top of the center post 70 of the skirt portion 34*a*, which, in turn, is driven by the oscillating drive shaft 36*a*. Associated with the clutch 75 are a machine screw 43*a* to clamp the stem 73 of the center post 70 of agitator skirt portion 3*a* to the upper end of the drive shaft 36*a*. The clutch 75 includes a coil spring 64*a* which bears between an upper surface of clutch member 75*a* of the clutch 75 and an under surface of a plate 44*a* which is clamped atop the stem 73 by the machine screw 43*a*. One form of clutch drive which may be used in connection with the present invention is more fully described in the co-pending application of Frank R. Burgener, Jr. et al, U.S. Ser. No. 686,135, filed May 13, 1976 assigned to the assignee of the present invention.

Figure 7:
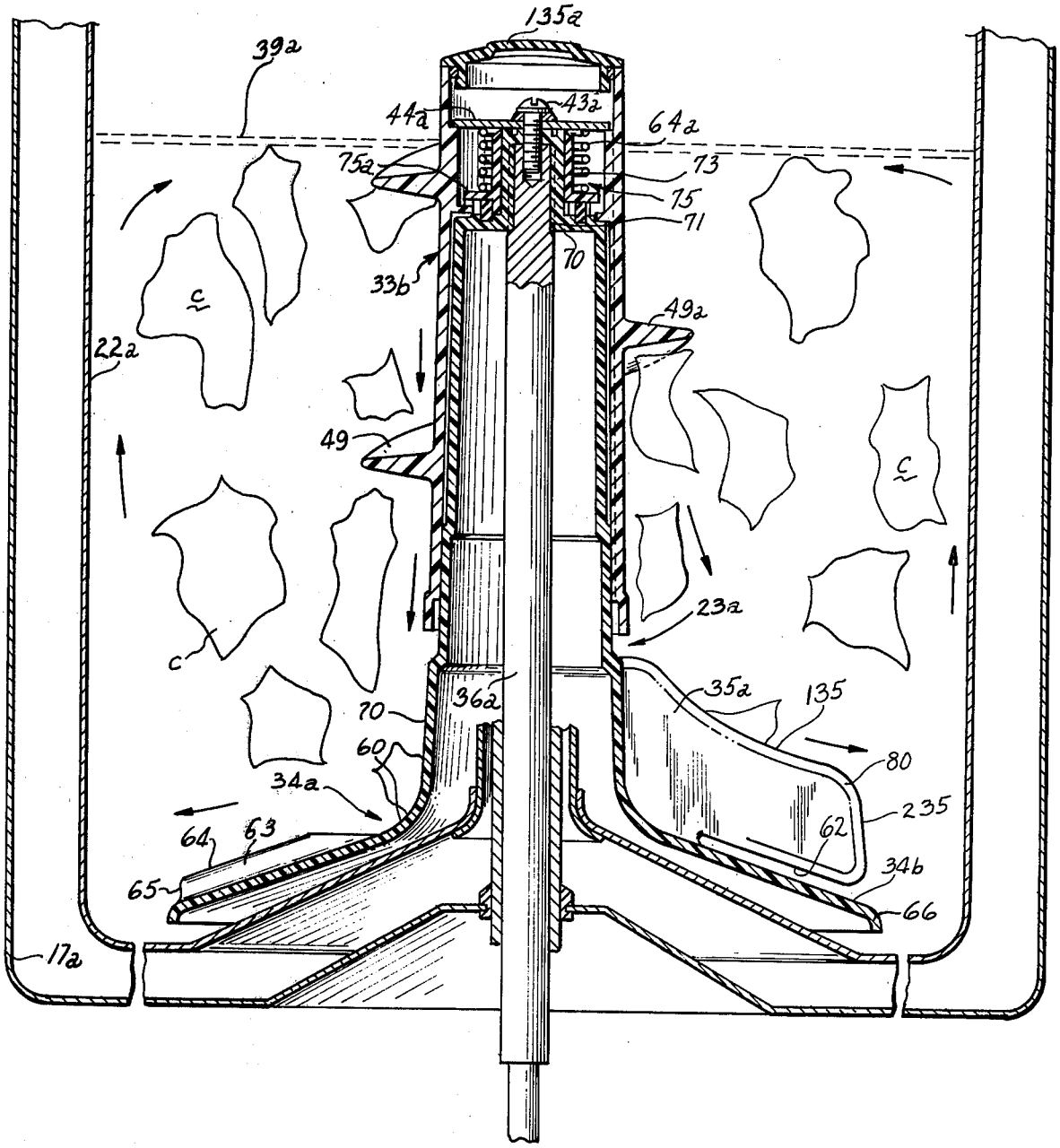
FIG. 7 is a cross-sectional view through the vertical axis of the washing machine tub and agitator assembly, on line VII—VII of FIG. 6, and indicating movement of the clothes, fabrics and washing fluid within the tub.

In the preferred embodiment of FIGS. 5–8, the drive shaft 36*a* rotates the center post 70 in either direction through shaft spline 71 and a cooperatively splined interior surface on center post stem portion 73. A ratchet surface (not shown) of the clutch member 75*a* mounted at the top of the center post 70 engages a corresponding ratchet surface on an internal cylinder of the auger tube 33*b*. When the drive shaft 36*a* rotates to the left as shown in FIG. 7, teeth (not shown) of the ratchet surface of the clutch 75 engage the valleys of the ratchet surface (not shown) in the auger tube 33*b*, forcing the auger tube 33*b* also to rotate to the left. On the return stroke of the oscillatory drive shaft 36*a* and center post 70, to the right, the ratchet surface on the auger tube 33*b* will rise vertically and slip from tooth to tooth of the ratchet rather than rotate in the reverse direction against its own momentum and the resistance of the washing fluid and articles undergoing washing about its exterior.

The outer portion of the auger tube 33*b* has a single helical vane 49*a* beginning above the normal maximum water line 39*a* in the tub 17*a* and progressing downwardly in a counterclockwise direction in the orientation of FIG. 5, so that when the auger tube 33*b* is rotated to the left in the orientation of FIG. 6, washing liquid and fabric articles C in the clothes basket 22*a* will be forced downwardly adjacent the agitator assembly 23*a*.

In operation, articles undergoing washing such as clothes and fabrics C will be placed within the clothes basket 22*a* within the imperforate tub 17*a* and the tub 17*a* is filled with water to the level 39*a* as indicated. In a washing cycle, the drive shaft 36*a* will rotate back and forth, in clockwise and counterclockwise directions, alternately, oscillating the skirt and vane portion 34*a* of the agitator assembly 23*a* through the drive connection formed by the engagement of the splined segment 71 of the drive shaft 36*a* with the splined interior surface on center post stem portion 73, onto which the center post 70 of the skirt and vane portion 34*a* is non-rotatably keyed or attached. Thus, the skirt and vane portion 34*a* oscillates within the clothes basket 22*a*, establishing a generally radial flow pattern at the bottom of the clothes basket 22*a* and providing scrubbing and flexing action to the clothing C passing adjacent the skirt 34*a*. Simultaneously with oscillation of the skirt portion 34*a*, assuming a relatively large clothes load and a proper water level for such load, the auger portion 33*b* of the agitator assembly 23*a* is moved in step-wise rotations generally in a single direction under the action of the clutch. Helical vane 49*a* on the exterior of the auger tube 33*b* forces washing liquid and clothing and the like C adjacent the upper part of the agitator assembly 23*a* in a downward direction and into the area of radially outward flow induced by the vanes 35*a* and 63. The clothes and fabrics C and washing fluid associated therewith therefore will flow in a generally toroidal pattern about the interior of the clothes basket 12 as indicated in FIGS. 6–8.

In FIG. 6 the arrow shown on the upper surface of agitator assembly 23*a* indicates the clockwise direction of rotation of auger portion 33*b*. In the operation of the washing machine structure of the present invention, during washing the clothes and fabrics C undergoing washing move, or precess, in a clockwise direction around the axis of the agitator assembly with rollover occurring in a generally spiral toroidal pattern 23*a* as indicated by the arrows 80 in FIGS. 6 and 8. This spiral toroidal rollover pattern precessing around the vertical axis of the agitator assembly is produced by the rotary action (whether unidirectionally intermittent rotary action or continuously rotary action) of the upper agitator element and the simultaneously occurring oscillatory action of the lower vaned agitator element on the clothing and fabrics being washed within basket 22*a*. The flexible vanes will flex, yield, and give way under rotational loading when engaging fabrics, which action promotes the separation of such fabrics from the outer ends of those flexible vanes during their oscillatory movement. This unloading, freeing up, or unfettering of the ends of these vanes lessens the tendency for clothing to become tangled on them and ultimately on the rest of the agitator assembly. This in turn minimizes undue concentration of immobile fabrics near these vanes at the bottom of the agitator assembly and thereby allows the relatively unfettered flexible vanes to continue to generate the desired rollover patterns within basket 22*a* by their propulsion action without creating high agitator shaft torque loads in doing so.

In soil removal tests of the preferred embodiment of the present invention shown in FIGS. 5–8, the disclosed structure demonstrated outstanding rollover of the clothes and fabrics undergoing washing as compared to conventional clothes washing machines. The entire clothes load was uniformly washed with only very narrow differences between soil removal results for various parts of the load. The test results showed less clothes tangling than would normally be expected, with no objectionable high agitator shaft torque or high motor wattage. Thus the present invention provides an improved auger agitator with improved rollover action which is substantially free of any clothes tangling or related problems.

Figure 9:
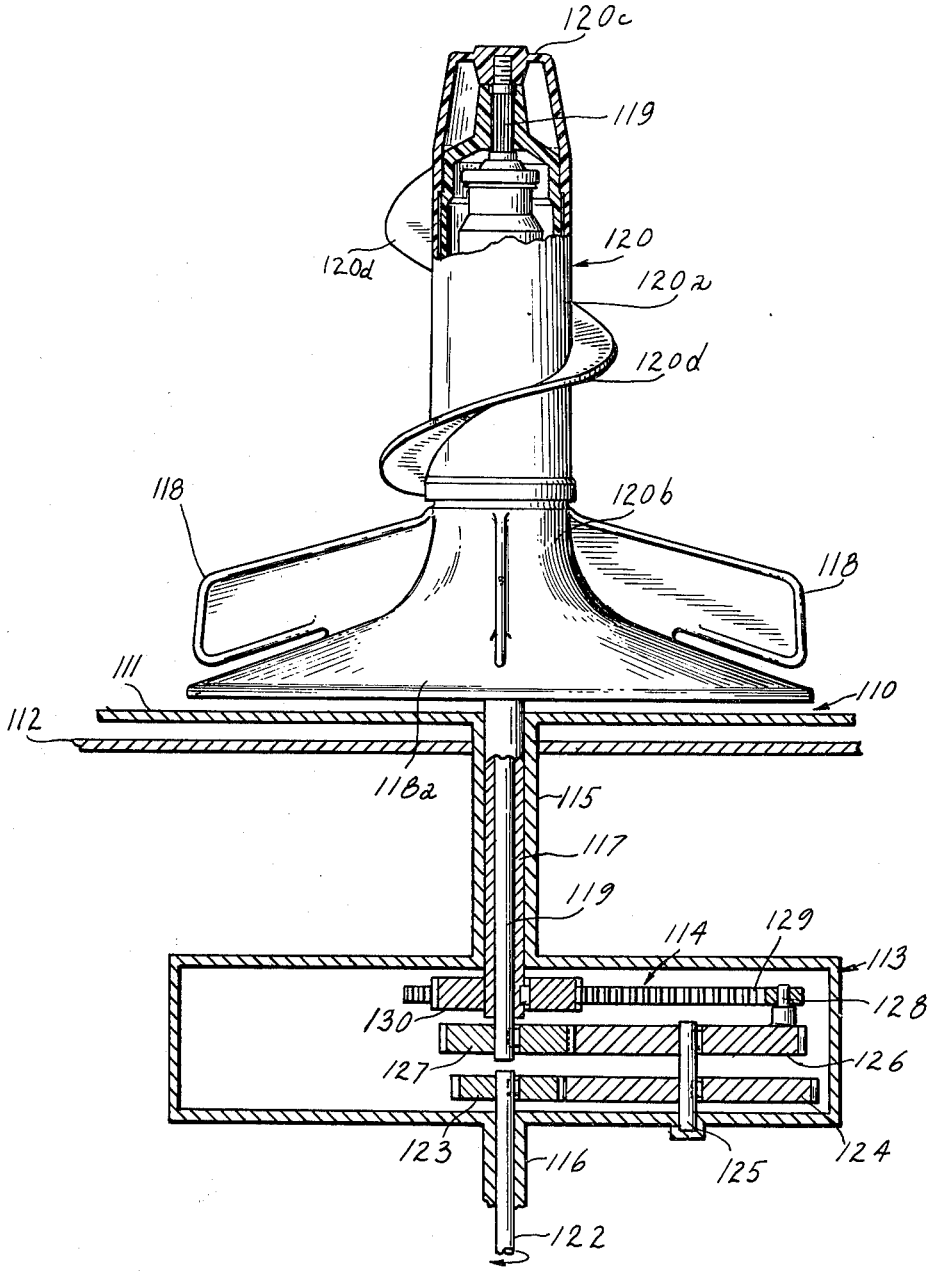
FIG. 9 is a fragmentary vertical cross-sectional view of a modified form of the invention providing a continuous rotary motion for the auger element of the agitator and an oscillatory motion for a skirt portion of the agitator having scrubbing vanes attached thereto.

FIG. 9 illustrates an alternative embodiment of my invention in which the upper helical auger agitator element is rotated continuously in one direction rather than being driven in an intermittent unidirectional rotary motion such as illustrated in the embodiment of FIGS. 1–8. The embodiment of FIG. 9 represents a modified auger mechanism over those of the prior embodiments for feeding clothing and fabrics downwardly into the path of the lower oscillatable agitator element which is oscillated in a manner and rate similarly to that for the lower agitator elements of the prior embodiments shown in FIG. 1–8.

In FIG. 9, the washing machine 110 (only partially shown) includes a basket or receptacle 111 provided with perforations (not shown) and positioned within an imperforate fluid retaining tub 112. A transmission housing 113 located beneath tub 112 encloses a transmission generally identified by numeral 114. The transmission housing 113 is connected at its upper end to receptacle 111 by tubular shaft 115 and is connected at its lower end to a hollow transmission input drive shaft 116.

Journalled for oscillation within the hollow shaft 115 is a tubular shaft 117 which is directly connected to the lower vaned oscillatable agitator element **120*b* which is similar in size, function and configuration to the lower agitator element 34*a* shown in embodiment of FIG. 5. Lower agitator element 120*b* includes four flexible vanes 118 attached to the central hub and skirt portion of agitator element 120*b*. One or more rigid vanes, not shown but similar to the embodiment of FIG. 5 herein, may also be carried on element 120*b* between vanes 118**.

Journalled for rotation within tubular shaft 117 is the rotatable agitator input drive shaft 119 which extends upwardly to the top of the agitator assembly positioned within receptacle 111 and generally designated by numeral 120.

The agitator assembly 120 includes an upper agitator auger agitator element **120*a*, a lower agitator vaned agitator element 120*b*, and an agitator cap 120*c* threaded on the upper end of agitator shaft 119. As in the prior embodiments, the lower vaned agitator element 120*b* is intended for oscillation about its vertical axis at an optimum rate within a range of approximately 50 to 200 oscillations per minute depending upon the characteristics of the drive system desired. As in the embodiment of FIG. 5 the lower agitator element 120*b* includes flexible vanes 118 and a skirt 118*a*** spaced beneath those vanes.

The upper auger agitator element **120*a*, which includes a helical vane 120*d*, is intended to rotate continuously in one direction so as to urge or force its adjacent clothing and fabrics downwardly into the path of the lower agitator element 120*b*. The rotational rate of the upper auger agitator element 120*a* is dependent upon the size, shape, and helical pitch of the auger agitator element 120*a*** itself but may be in the range of approximately 60 r.p.m. or less.

The function of transmission 114 is to provide a continuous rotary motion to the agitator drive shaft 119 while simultaneously providing an oscillatory motion to the tubular agitator drive shaft 117 during the agitation portion of the washing cycle of washing machine 110 in addition to providing a rotary motion to the clothes basket spin tube 115 during the fluid extraction portions of that washing cycle.

The mechanical power for producing the desired movements of agitator elements **120*a* and 120*b* is supplied to the rotary transmission input drive shaft 122 which is journalled within the tubular transmission input drive shaft 116 and coaxially aligned with shaft 119. Input drive shaft 122 is keyed to pinion gear 123 which drives spur gear 124 keyed to the jack shaft 125 suitably mounted for rotation on the bottom wall of transmission housing 113. Jack shaft 125 is keyed to gear 126 which provides two power paths to agitator 120. The first power path is provided through gear 127 which meshes with gear 126 and which, in turn, is keyed to the agitator drive shaft 119. The second power path is provided through the crank pin 128 which is carried by gear 126 and which journals one end of the toothed rack 129 which meshes with and drives the gear 130 which in turn is keyed to the tubular agitator drive shaft 117**.

In operation during the agitation portion of the washing cycle when tubular shaft 116 and transmission housing 113 are stationary, rotation of transmission input shaft 122 in a clockwise direction, as viewed from the bottom of FIG. 9, causes gears 123, 124, 126 and 129 to rotate in a direction so as to cause the upper auger agitator element **120*a* to force its surrounding fabrics and clothing downwardly toward and into the path of agitator element 120*b***.

Rotation of shaft 122 and gears 123, 125, and 126 also causes crank pin 128 to reciprocate rack 129 back and forth so as to produce an oscillatory motion of pinion gear 130 and the tubular shaft 117 to which gear 130 is keyed. Oscillation of shaft 117 produces a similar oscillatory motion of the lower vaned agitator element **120*b***.

During the extraction portions of the washing cycle, the rotation of shaft 116 causes transmission housing 113, shaft 115 and ultimately receptacle 111 to rotate to effect the desired centrifuging operation.

While transmission 114 has been shown and described herein for illustrative purposes in driving agitator 120, it should be understood that other continuous driving mechanism can be utilized. It can be seen from this embodiment of FIG. 9 that an auger agitator assembly has been provided wherein the upper auger agitator element is continuously rather than intermittently rotated as shown and described in the prior embodiments of my invention.

From the foregoing, it will be seen that the present invention provides an agitator means having a lower agitator element provided with flexible vanes mounted for oscillatory motion about an axis and an upper agitator element mounted for unidirectional rotation about the same axis, the upper agitator element having means associated therewith for urging clothes adjacent the upper portion down to the lower portion of the agitator means. This type of double action or rollover action agitator especially improves the washing action of heavy loads of clothes because the unidirectional upper portion urges the clothes down to the oscillating lower portion for positive rollover and washing action. Thus the present invention provides improved means for effectively washing a relatively large clothes load with a given amount of washing liquid thereby permitting economies in water usage, detergent usage, and power usage for heating and washing liquid. The agitator means provides good washing action for both light and heavy loads, with the oscillating lower portion providing most of the action on the light loads. In addition, the agitator means is simple and easy to construct and can be accommodated on conventional drive systems. Furthermore, the pitch of vanes associated with the agitator means can be varied to change the downward movement of the clothes during agitation, thereby making the agitator means more readily adaptable to various sizes and shapes of baskets. Additionally, the drive for the auger element may be in the form of a clutch to provide intermittent stepwise rotation, or a direct drive to provide continuous rotation of the auger element.

Although various other modifications might be suggested by those versed in the art, it should be understood that I wish to embody within the scope of the patent warranted hereon all such modifications as reasonably and properly come within the scope of my contribution to the art.

I claim:

1. An agitator assembly for a clothes washing machine comprising:

a first agitator element, a second agitator element, drive means for driving said first agitator element in an oscillatory motion and for concurrently driving said second agitator element in an unidirectional rotary motion, said first and second agitator elements cooperating to circulate the contents of the machine in a toroidal rollover pattern within the washing machine, and means associated with said second agitator element for forcing articles adjacent thereto into the oscillatory path of said first agitator element and into said rollover pattern, said first agitator element having formed thereon flexible vanes which are free to flex in response to oscillatory motions of the agitator element, thereby to yieldingly engage fabrics deflected downwardly and lessening high impact loading of the first agitator element.

2. An agitator assembly as defined in claim 1, wherein said first agitator element is provided with a skirt spaced subjacent said flexible vanes which extends under each of said flexible vanes.

3. An agitator assembly as defined in claim 2, further defined by each of said flexible vanes being separated from said skirt along a greater portion of its length by a space between said skirt and said vane, thereby to allow flexing of said flexible vane during washing action.

4. An agitator assembly as defined in claim 3, wherein said flexible vanes each have free or detached upper, outer, and lower edges to facilitate free flexing of said flexible vane during washing action.

5. An agitator assembly as defined in claim 1, wherein said drive means is constructed and arranged to intermittently drive said second agitator element.

6. An agitator assembly as defined in claim 1, wherein said drive means is constructed and arranged to continuously drive said second agitator element.

7. In a clothes washing machine of the vertical axis type having a washing receptacle for receiving washing liquid and fabrics to be washed, agitator means within said receptacle for washing fabrics and for generating a rollover motion to said fabrics during washing of the fabrics, and drive means for driving said agitator means, said agitator means comprising:

a lower agitator element driven by said drive means in an oscillatory motion on said vertical axis, an upper agitator element mounted on said vertical axis above said lower agitator element, said upper agitator element being positively and unidirectionally rotated by said drive means on said vertical axis, means on said upper agitator element for deflecting said fabrics downwardly toward said lower agitator element in a first portion of a toroidal rollover pattern for said fabrics by the coaction of said upper and lower elements, said lower agitator elements including a plurality of circumferentially-spaced, radially-extending, flexible vanes having relatively free end portions positioned outwardly from said vertical axis, and a skirt portion closely positioned beneath said end portions whereby said end portions may flex relative to said skirt portion upon oscillation of said lower agitator element and yieldingly propel said fabrics away from said vertical axis and into a second portion of said toroidal rollover pattern so as to be reengaged by said upper agitator element and thereby generate a continuous rollover motion of said fabrics.

8. The invention set forth in claim 7 wherein said drive means includes a drive member which is directly connected to said upper agitator element and constructed and arranged such that said upper agitator element is continuously rotated in one direction on said vertical axis during washing of fabrics.

9. In a clothes washing machine of the vertical axis type having a washing receptacle for receiving washing liquid and fabrics to be washed, agitator means within said receptacle for washing fabrics and for generating a rollover motion to said fabrics during washing of the fabrics, and drive means for driving said agitator means, said agitator means comprising:

a lower agitator element driven by said drive means in an oscillatory motion on said vertical axis for scrubbing said fabrics during washing of said fabrics, an upper agitator element mounted on said vertical axis above said lower agitator element, said upper agitator element being positively and continuously rotated in one direction on said vertical axis by said drive means, and means on said upper agitator element for deflecting said fabrics downwardly toward said lower agitator element on rotation in one direction of said upper agitator element so as to generate a continuous rollover motion of said fabrics by the coaction of said upper and lower agitator elements.

10. The invention set forth in claim 9 wherein said lower agitator element includes a plurality of circumferentially- spaced, radially-extending, flexible vanes having relatively free end portions positioned outwardly from said vertical axis, and a skirt portion closely positioned beneath said end portions may flex relatively to said skirt portion upon oscillation of said lower agitator element during scrubbing of said fabrics and yieldingly propel said fabrics away from said vertical axis so as to coact with said upper agitator element in generating a continuous rollover motion of said fabrics.

11. In an automatic washer having a washing receptacle for containing washing liquid and the items to be washed, agitator means within said receptacle for imparting a rollover motion to said items to be washed, and drive means for driving said agitator means, said agitator means comprising:

a lower agitator element driven by the drive means in an oscillatory manner, an upper agitator element mounted above the lower agitator element and coaxial therewith, said upper agitator element being positively rotationally driven by the drive means in one direction only, means associated with the upper agitator element for imparting a downward motion to the items to be washed, and flexible vane means associated with the lower agitator element to yieldingly flex under heavy wash load conditions to minimize tangling of items to be washed due to the movement of said upper agitator element in said one direction only.

12. An agitator assembly for use within a vertical axis washing machine adapted to receive washing fluid and fabrics to be washed within said washing fluid, said agitator assembly comprising:

a first agitator member including means for receiving an oscillatory input drive member from said machine for imparting an oscillatory motion to said first agitator member, a second agitator member having fabric deflecting means thereon mounted adjacent said first agitator member and movable relative thereto for urging fabrics positioned adjacent said fabric deflecting means within said washing fluid toward said first agitator member in a generally toroidal fluid circulatory path to effect a scrubbing of said fabrics by said first agitator member, said second agitator member having drive means connected thereto for moving said second agitator member as a separate unidirectional rotational movement relative to said first agitator member, and flexible vane means on said first agitator element for uniformly scrubbing the fabrics to be washed while yieldingly flexing under relatively heavy load conditions thereby preventing any undue tangling of the fabrics caused by the unidirectional rotational movement of said second agitator member relative to said first agitator element.

13. In an automatic washing having a clothes washing receptacle, agitator means within said receptacle, and drive means having a drive shaft engageable with said agitator means, an improvement in said agitator means comprising:

a lower agitator element connected to said drive shaft for oscillating motion therewith, an upper agitator element disposed above the lower agitator element and coaxial therewith, means interconnecting said upper agitator element with said drive means for unidirectional rotation of said upper agitator element, and means on said lower agitator element for scrubbing clothes and for alleviating any tendency for tangling of the clothes occasioned by the unidirectional rotation of said upper agitator element, said means on said lower agitator element comprising a plurality of flexible vanes constructed and arranged to yieldingly flex under relatively heavy clothes wash load conditions.

14. An agitator assembly for a clothes washing machine of the type comprising first and second agitator elements respectively driven in oscillatory and unidirectional rotary motions to circulate the contents of the machine in a toroidal rollover pattern within the washing machine and wherein the second agitator element has means for forcing articles adjacent thereto into the oscillatory path of the first agitator element and into the rollover pattern, the improvement of a first agitator element having formed thereon flexible vanes which are free to flex in response to oscillatory motions of the agitator element, thereby to yieldingly engage fabrics deflected downwardly and lessening high impact loading of the first agitator element.

15. In a washing machine of the vertical axis type having an agitator assembly comprising in combination with a skirt and vane portion oscillatable about an axis and having a plurality of radial vanes spaced about said axis and an auger portion rotatable in one direction about said axis and having a radially extending vane forming a helix about said axis to provide positive toroidal rollover of the clothing in the machines, the improvement of a plurality of vanes of said agitator assembly spaced circumferentially of one another and each of said plurality of said vanes having free and detached upper, outer and lower edges to facilitate free flexing of said vanes relative to the skirt during washing to yieldingly engage downwardly deflected materials and lessening high impact loading of said skirt and vane portion of said agitator assembly.

16. In a washing machine of the vertical axis type having an agitator assembly comprising in combination with a skirt and vane portion oscillatable about an axis and having a plurality of radial vanes spaced about said axis and an auger portion rotatable in one direction about said axis and having a radially extending vane forming a helix about said axis to provide positive toroidal rollover of the clothing in the machine, the improvement of a continuous unidirectional driving means of continuously rotating said auger portion during a washing operation.

17. In a washing machine of the vertical axis type having an agitator assembly comprising in combination with a skirt and vane portion oscillatable about an axis and having a plurality of radial vanes spaced about said axis and an auger portion rotatable in one direction about said axis and having a radially extending vane forming a helix about said axis to provide positive toroidal rollover of the clothing in the machine, the improvement of a plurality of vanes for said agitator assembly having free and detached upper, outer and lower edges to facilitate free flexing of said vanes relative to said skirt during washing to yieldingly engage downwardly deflected materials and lessening high impact loading of said skirt and vane portion of said agitator assembly, and a continuous, unidirectional driving means for continuously rotating said auger portion during a washing operation.

* * * * *